US007356875B2

(12) United States Patent
Abdallah et al.

(10) Patent No.: US 7,356,875 B2
(45) Date of Patent: Apr. 15, 2008

(54) AIR EXHAUST SYSTEM FOR A CLEANING MACHINE

(75) Inventors: Sleiman A. Abdallah, North Canton, OH (US); Michael A. Durbin, Massillon, OH (US); Frank D. Fowler, North Canton, OH (US); Jeffrey S. Louis, Green, OH (US)

(73) Assignee: Healthy Gain Investments Ltd, Roadtown, Tortola (VG)

( * ) Notice: Subject to any disclaimer, the term of this patent is extended or adjusted under 35 U.S.C. 154(b) by 521 days.

(21) Appl. No.: 10/387,196

(22) Filed: Mar. 11, 2003

(65) Prior Publication Data

US 2004/0177473 A1 Sep. 16, 2004

(51) Int. Cl.
*A47L 7/04* (2006.01)

(52) U.S. Cl. ..... 15/345; 15/320

(58) Field of Classification Search ..... 15/320, 15/435, 346, 340.2; 134/21
See application file for complete search history.

(56) References Cited

U.S. PATENT DOCUMENTS

| | | | | | |
|---|---|---|---|---|---|
| 3,107,386 | A | * | 10/1963 | Mandin | 15/345 |
| 3,694,848 | A | * | 10/1972 | Alcala | 15/346 |
| 3,964,925 | A | | 6/1976 | Burgoon | 134/21 |
| 4,017,938 | A | * | 4/1977 | Crise | 15/346 |
| 4,300,261 | A | * | 11/1981 | Woodward et al. | 15/345 |
| 4,315,344 | A | * | 2/1982 | Woodward et al. | 15/345 |
| 4,597,124 | A | * | 7/1986 | Williams et al. | 15/321 |
| 5,392,490 | A | * | 2/1995 | Monson | 15/320 |
| 5,485,651 | A | | 1/1996 | Payeur | 15/321 |
| 5,500,977 | A | * | 3/1996 | McAllise et al. | 15/320 |
| 5,813,086 | A | * | 9/1998 | Ueno et al. | 15/320 |
| 5,933,912 | A | | 8/1999 | Karr et al. | 15/320 |
| 6,032,327 | A | * | 3/2000 | Oka et al. | 15/346 |
| 6,325,864 | B1 | * | 12/2001 | Zahuranec et al. | 134/21 |
| 7,039,985 | B2 | * | 5/2006 | Hisrich et al. | 15/320 |
| 7,171,722 | B2 | * | 2/2007 | Keller | 15/322 |
| 2001/0047562 | A1 | * | 12/2001 | Lenkiewicz et al. | 15/320 |
| 2002/0053115 | A1 | * | 5/2002 | Deng | 15/346 |

FOREIGN PATENT DOCUMENTS

| | | | |
|---|---|---|---|
| GB | 2277677 | * | 9/1994 |
| GB | 2292882 | A | 3/1996 |
| GB | 2377624 | * | 1/2003 |

OTHER PUBLICATIONS

Specification Sheet and photograph of the bottom view of the SteamVac (tm) model F5805 owned by the Hoover Co., received on Mar. 5, 1994.

Photographs of Bissell Proheat Plus, Model 1698-1, Received Jan. 1999.

Photographs of Hoover SteamVac Plus, Model F5873-900 owned by The Hoover Company, Received Jun. 20, 1998.

* cited by examiner

*Primary Examiner*—Theresa T Snider

(57) ABSTRACT

A cleaning machine for cleaning a surface in which cleaning solution is dispensed to the surface and substantially extracted along with the dirt on the surface in a continuous operation is provided. The cleaning machine includes an airflow source that produces an airflow directed out of an outlet. A duct cover covers the outlet. The duct cover includes at least one opening that is sized and oriented to distribute the air evenly across the outlet.

31 Claims, 10 Drawing Sheets

AIR EXHAUST SYSTEM FOR A CLEANING MACHINE

BACKGROUND OF THE INVENTION

1. Field of the Invention

The present invention relates to an air exhaust system for a cleaning machine. More particularly, the present application pertains to an air exhaust system of a cleaning machine that evenly distributes air across the cleaning path.

2. Background Information

It is known in the prior art to provide a cleaning machine in which air is exhausted out of the machine. For example, U.S. Pat. No. 5,500,977 issued to McAllise et al. discloses such a carpet extractor. Specifically, as depicted in FIG. 8B of this patent, when extractor 10 is operated in the floor cleaning mode to clean the carpet, cleaning solution, upon the operator's command, is discharged from the cleaning fluid supply tank 40, passing through the supply line 328, and into the fluid distributor 650 positioned within air discharge nozzle 65 whereby the cleaning fluid is atomizingly distributed throughout the discharged air and conveyed thereby to the carpet being cleaned. Simultaneously, working air, including cleaning fluid and dirt from the carpet, is drawn into floor nozzle 70, through floor conversion module 526, air/fluid separator lid 55 and into the recovery tank 510. Warm, moist exhaust air, from motor fan 610, is discharged through discharge nozzle 65 and directed toward the surface being cleaned.

Another example of a carpet extractor is disclosed U.S. Pat. No. 6,325,864. With particular reference to FIG. 4, the lower housing portion 22 defines an exhaust chamber 238 at the base of the fan housing compartment 78. The working air leaves the fan housing compartment through the exhaust chamber in the direction of the floor surface through exit slots 240 defined in the plate 96, as shown in FIG. 5.

It would be desirable to have a cleaning machine with an air exhaust system that distributes the air substantially evenly across the cleaning path. It would also be desirable to design an air exhaust system of a cleaning machine that increases the temperature of the exiting air.

Hence, it is an object of the present invention to provide a cleaning machine having an air exhaust system that evenly distributes air across the cleaning path.

It is another object of the present invention to provide an air exhaust system that increase the temperature of the exiting air.

SUMMARY OF THE INVENTION

The foregoing and other objects of the present invention will be readily apparent from the following description and the attached drawings. In one embodiment of the present invention, a cleaning machine for cleaning a surface in which cleaning solution is dispensed to the surface and substantially extracted along with the dirt on the surface in a continuous operation is provided. The cleaning machine includes an airflow source that produces an airflow directed out of an outlet. A duct cover covers the outlet. The duct cover includes at least one opening that is sized and oriented to distribute the air evenly across the outlet.

A cleaning machine for cleaning a surface in which cleaning solution is dispensed to the surface and substantially extracted along with the dirt on the surface in a continuous operation is provided. The cleaning machine includes a housing, an airflow source operatively connected to the housing, and a distributor operatively connected at least in part to the housing. The distributor includes an outlet in which the cleaning solution flows out to the surface. An outlet is associated with the airflow source for directing air generated by the airflow source out of the cleaning apparatus. A duct cover covers the outlet of the airflow source and is located rearwardly from the outlet of the distributor. The duct cover includes at least one opening that is sized and oriented to distribute the air evenly across the outlet of the airflow source as it flows across and out of the outlet of the airflow source.

In another aspect of the invention, a method for cleaning a surface using a cleaning machine is disclosed. The method includes the steps of moving the cleaning machine across the surface, flowing hot air from the cleaning machine substantially and evenly across the cleaning path, distributing cleaning solution from the cleaning machine across the cleaning path, and recovering the cleaning solution and dirt using the cleaning machine.

BRIEF DESCRIPTION OF THE DRAWINGS

The invention will now be described, by way of example, with reference to the attached drawings, of which.

DETAILED DESCRIPTION OF THE INVENTION

Figure 1:
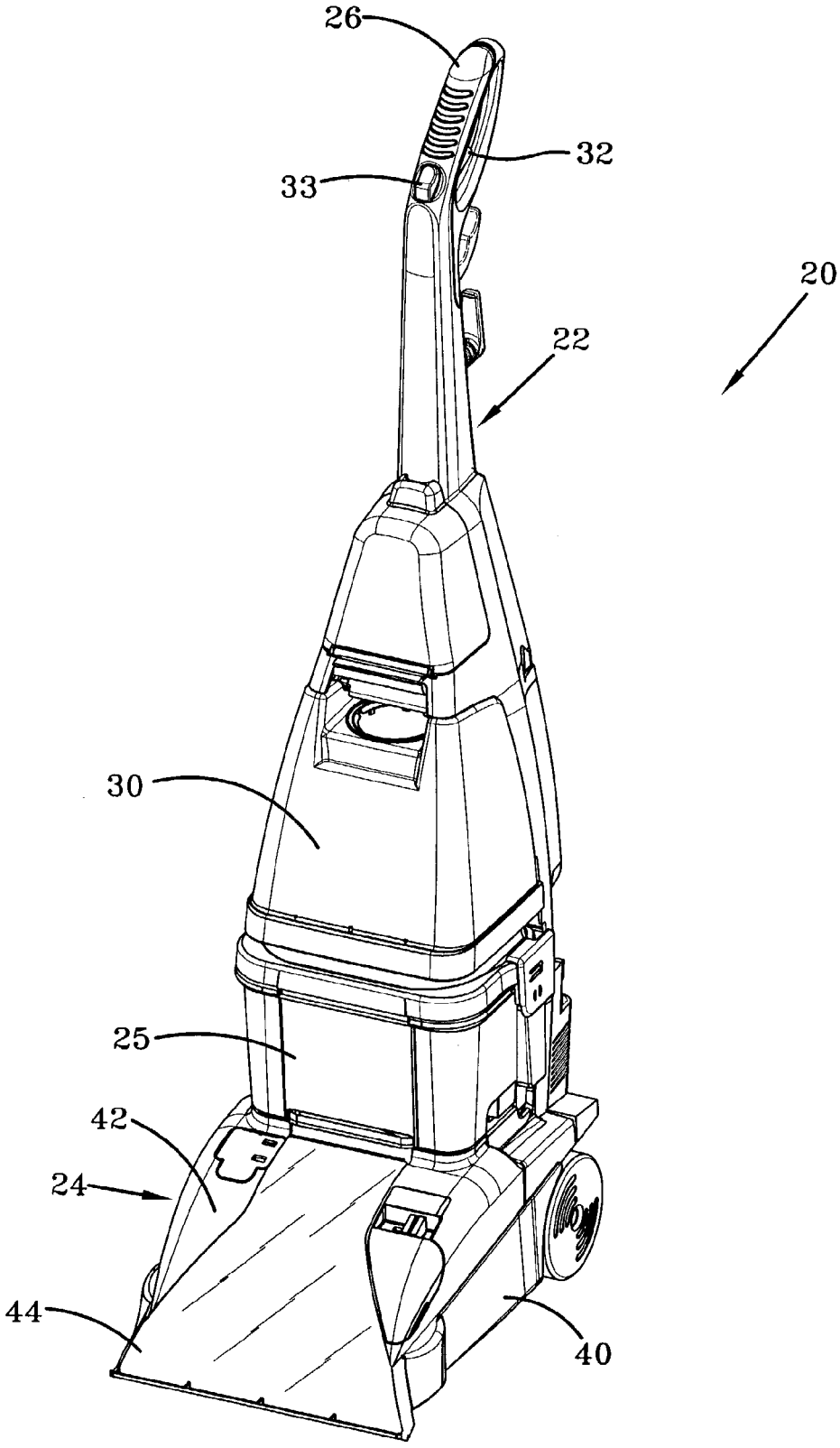
FIG. 1 is perspective view a carpet extractor incorporating the present invention.

In one embodiment of the present invention, a cleaning machine in the form of an upright style carpet extractor 20 is illustrated in FIG. 1. The upright carpet extractor 20 includes a handle portion 22 pivotally connected to a floor-engaging portion or base assembly 24. The handle portion 22 has a hand grip 26 for propelling the base assembly 24 over a carpeted or bare floor. The handle portion 22 pivots from a generally upright, locked storage position (as illustrated in FIG. 1), through an inclined operating position, and to a generally horizontal recovery tank 25 removal position. A conventional foot actuated handle release lever 28 (FIG. 3) is provided for unlocking the handle portion 22 when it is desired to pivot the handle portion 22 from the locked storage position.

A solution tank 30 for holding cleaning solution is releasably mounted to the handle portion 22 as disclosed in commonly owned U.S. Pat. No. 5,406,673 entitled Tank Carry Handle and Securement Latch issued on Apr. 18, 1995, the description of which is hereby incorporated herein as of reference. The handle portion 22 further includes a user operated trigger switch 32 that actuates a fluid release valve assembly disclosed in the above referenced patent for dispensing cleaning solution.

Figure 2:
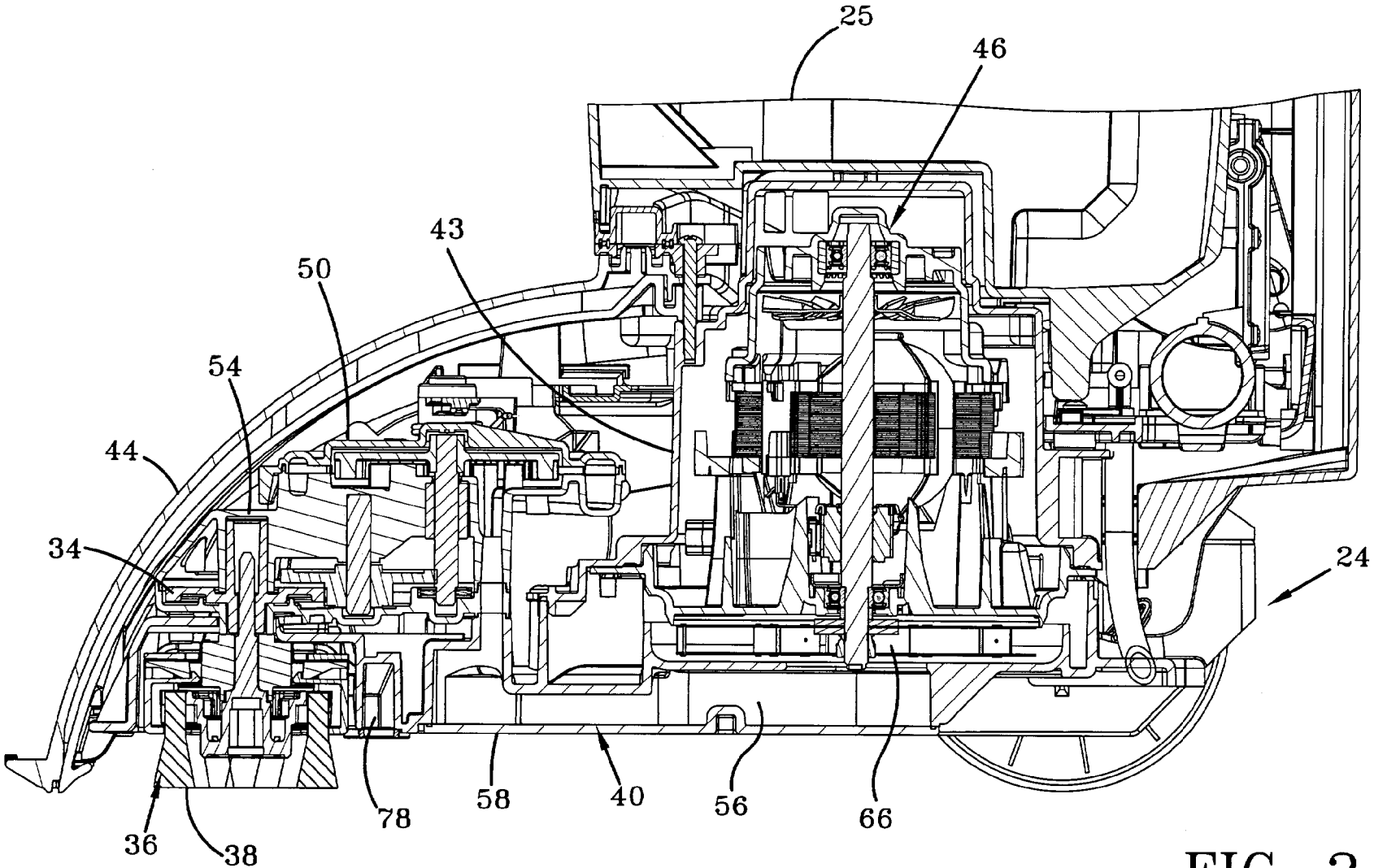
FIG. 2 is a fragmentary side elevational cross-section taken vertically through the center of the carpet extractor of FIG. 1.

Referring to FIG. 2, the cleaning solution, which generally comprises detergent and/or clean water, exits the valve assembly and travels through a main supply tube to a cleaning liquid distributor 34 provided on a brush assembly 36 of the base assembly 24. The cleaning liquid distributor 34 evenly distributes the cleaning liquid to each of the rotary scrub brushes 38. The scrub brushes 38 then spread the cleaning liquid onto the carpet (or bare floor), scrub the cleaning liquid into the carpet, and dislodge embedded soil. Such a distributor 34 and scrub brushes 38 are substantially disclosed in commonly owned U.S. Patent No. 5,867,857, the disclosure of which is hereby incorporated herein as of reference.

As best seen in FIG. 1, base assembly 24 comprises a lower housing 40 and an upper housing 42 which generally separate along parting a line. A suction nozzle 44 is mounted in a depression on the upper housing 42. The general structural arrangement and assembly of lower housing 40, upper housing 42, and nozzle 44 is similar to that as taught in the above referenced co-owned Pat. No. 5,406,673.

Figure 3:
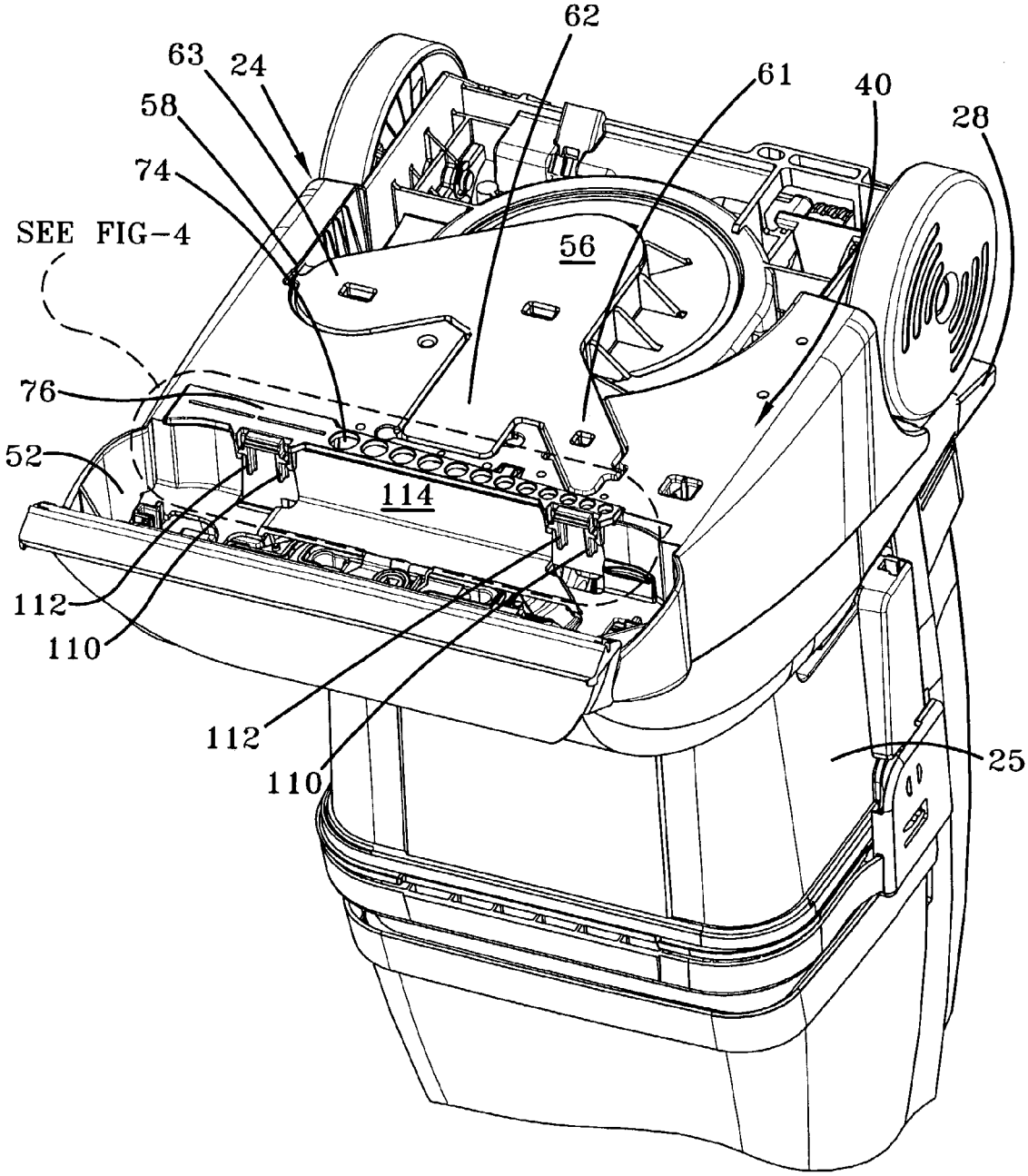
FIG. 3 is a fragmentary front and bottom perspective view of the carpet extractor of FIG. 1 with the brush assembly removed for illustrative purposes.

With reference to FIG. 2, the lower housing 40 comprises a one-piece molded body or frame (similar to that as taught in the above referenced U.S. patent) having affixed thereto a motor fan assembly 46 for providing a working vacuum for the extractor 20, and air driven turbine 50 providing motive power for the floor scrubbing brush assembly 36 contained within base housing brush cavity 52 (FIG. 3). Brush assembly 36 is operated by a suitable gear train (or other known means), not shown, contained in transmission housing 54. A suitable air turbine driven gear train is taught in co-owned U.S. Pat. No. 5,443,362 issued on Aug. 22, 1995 and titled "Air Turbine". Also affixed to the lower housing 40 is an air turbine driven fluid pump (not shown) for providing a pressurized cleaning solution supply for an above floor cleaning device. The structure of the air turbine driven fluid pump and its general operation and functional use is fully described in co-owned U.S. Pat. No. 5,406,673 referenced above.

The motor fan assembly 46 provides suction to a manifold 56 through the fan inlet or eye 66. Recovery tank 25 removably sets upon the motor fan assembly 46. In operation, the manifold 56 of motor fan 46 fluidly communicates with the recovery tank 25 via standpipe 72 (FIG. 6) thereby creating a vacuum within the recovery tank 25. When the extractor 20 is operated in the floor cleaning mode, working air, including entrained fluid and dirt, is drawn into the floor nozzle 44, through the air/fluid separator lid and into the recovery tank 25. The separated warm, moist exhaust air, from the motor fan 46, is then directed on the surface being cleaned.

Figure 4:
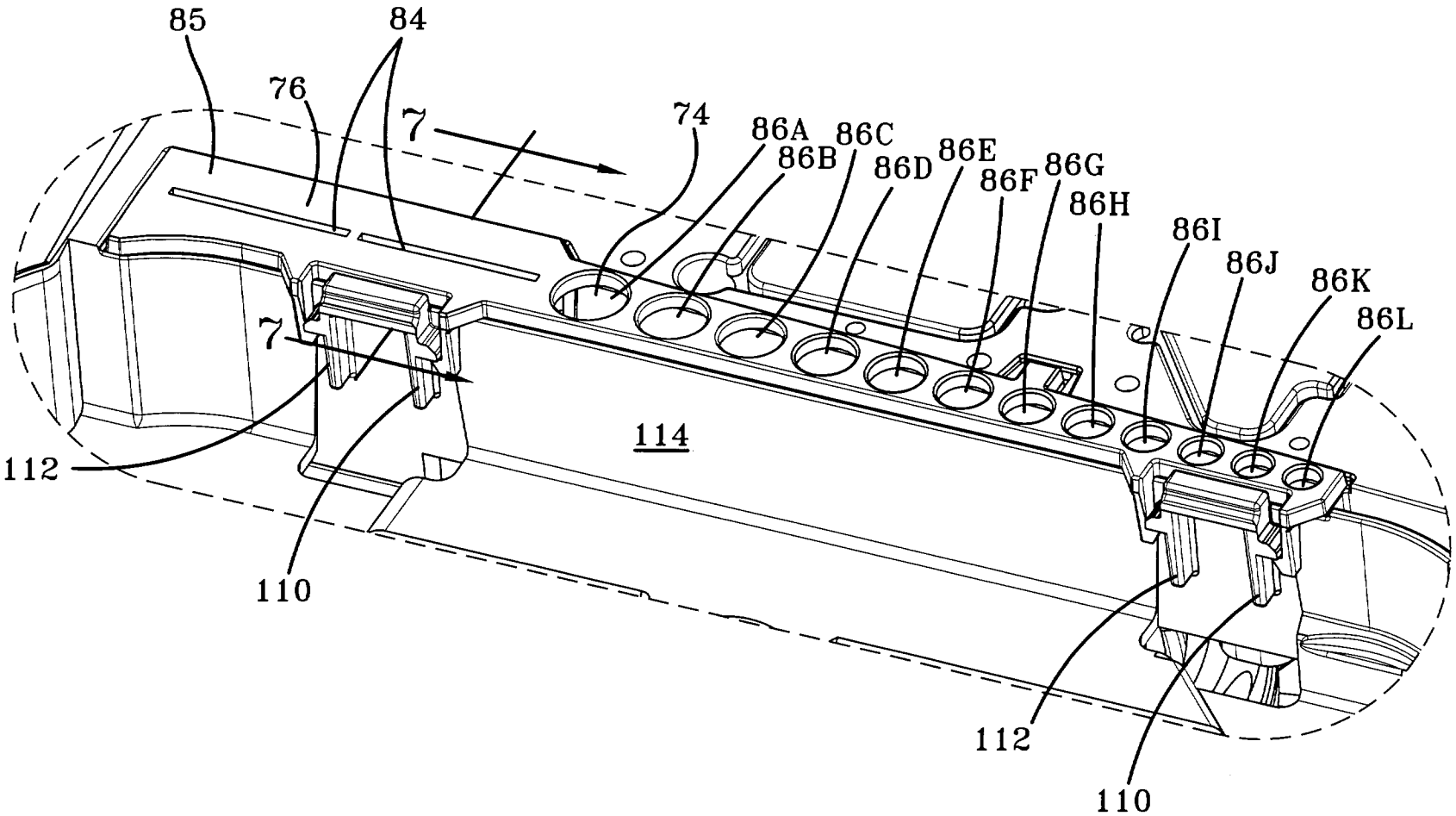
FIG. 4 is an enlarge view of the portion of FIG. 3 indicated by the oval.
Figure 5:
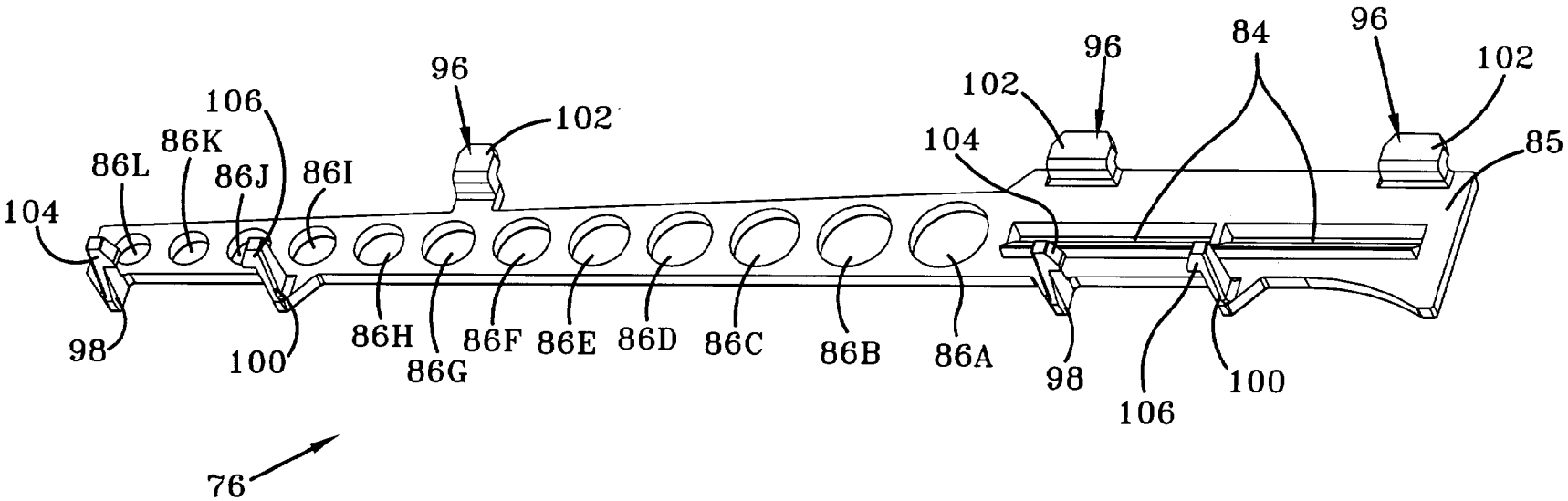
FIG. 5 is a perspective view of the duct cover of the present invention.

As seen in FIG. 3, integrally molded into the underside of lower housing 40 is the vacuum manifold 56 having extensions 61, 62, and 63 for providing a vacuum source for the air turbines. Manifold 56 is completed by a welded two-piece bottom plate 58. An outlet 74 is provided in the bottom plate 58 by which the working air exhausts out. The outlet 74 defines a duct or channel 78 (FIG. 6) extending substantially across the width of the base assembiy 24 with respect to the cleaning path. A duct cover 76 is mounted over the channel 78 and is oriented in a plane parallel to the bottom plate 58. The channel 78 is Located parallel and rearwardly adjacent to the brush assembiy 36 of the carpet extractor 20. As best seen in FIG. 7, the channel 78 is formed by a top wall 80, a front wall 81, and a rear wall 82 of the lower housing 40. Going from the upstream end to the downstream end of the channei 78, the top wall 80 tapers inwardly or downwardly within the channel and the rear wall 82 tapers inwardly or forwardly within the channel 78 thereby causing the cross sectional area of the channel 78 to gradually decrease going downstream. As seen in FIGS. 4 and 5, the duct cover 76 has a pair of collinear slits 84 at its upstream end 85 and a row of circular vent openings 86A-L that are sized and arranged along the duct cover 76 to allow the air to exit evenly across the tapered channel 78.

Figure 6:
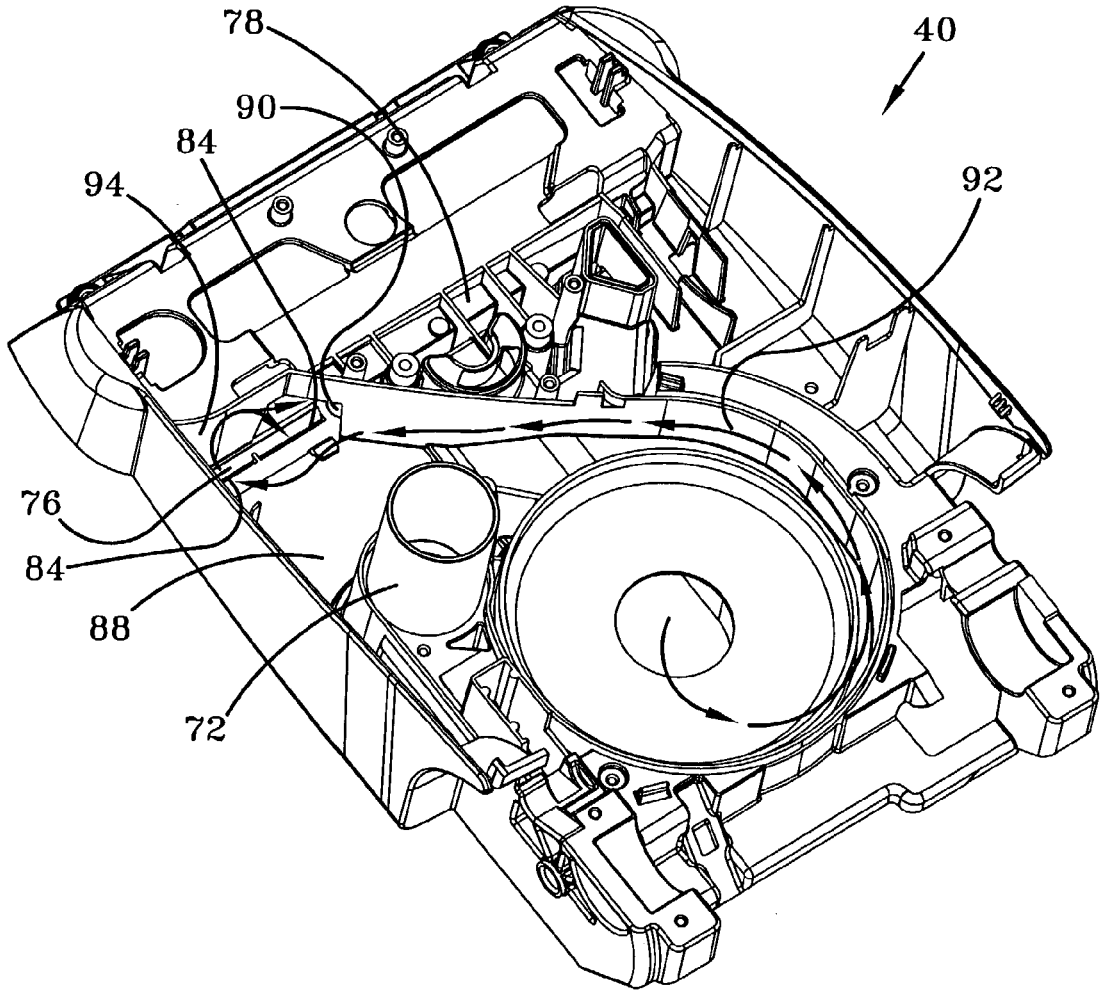
FIG. 6 is a top perspective view of the lower housing of the carpet extractor of FIG. 1 with the duct cover mounted thereto.
Figure 7:
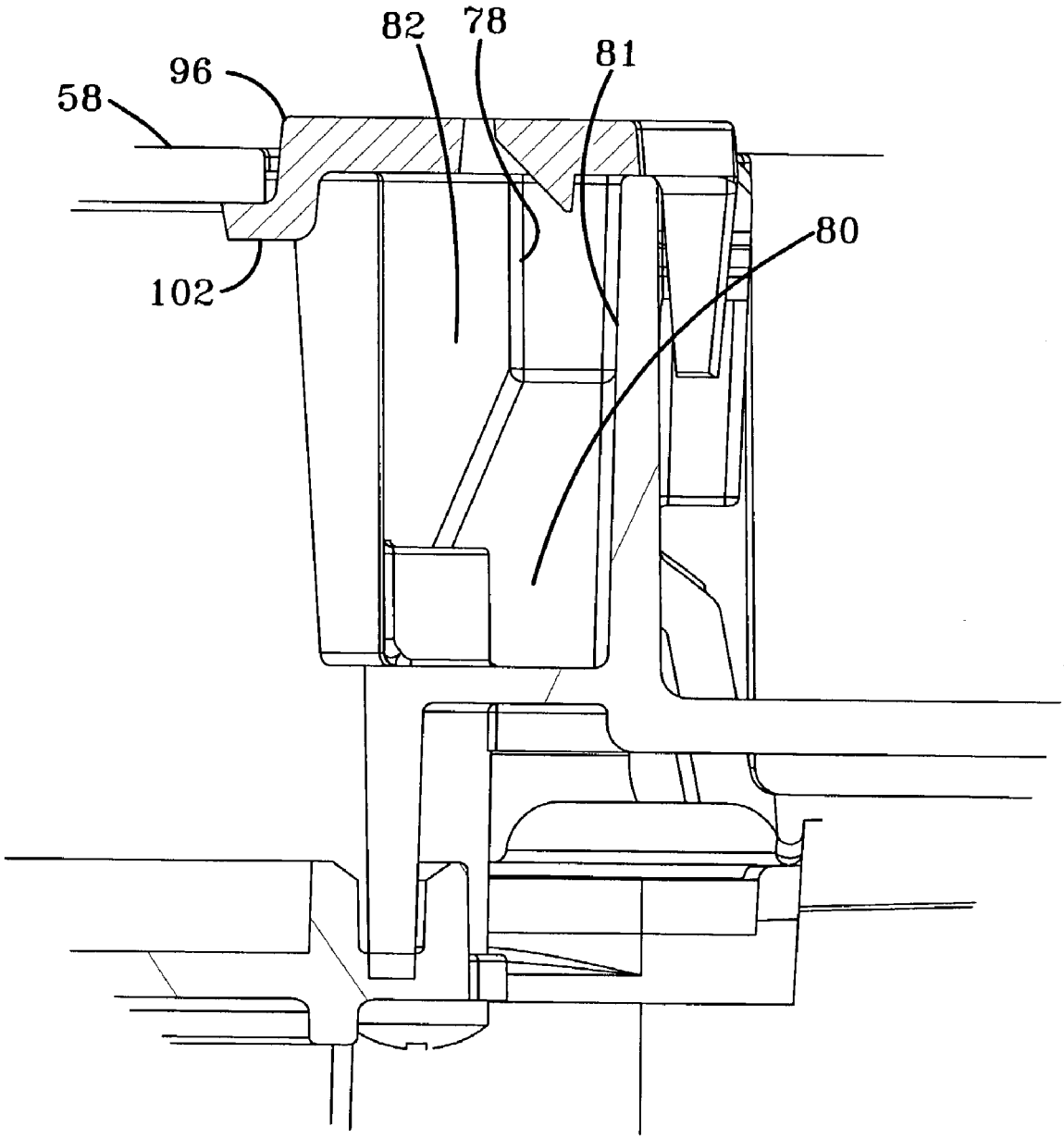
FIG. 7 is a sectional view as taken along line 7-7 in FIG. 4.

In particular, as indicated by the arrows depicted in FIG. 6, the working air flows out of the eye 66 of the motor fan 46 (FIG. 2) into a manifold 88. The manifold is formed by the lower housing 40 and motor cover 43, and a curved partition 92 which extends forwardly to an integrally formed wall 94 adjacent the brush assembly 36. The working airflow is directed by the partition 92 to the left corner of the manifold at the entrance 90 of the channel 78. The air flows at a relatively high velocity to the corner until it hits the wall 94, which directs the air down to the slits 84 of the duct cover 76. To prevent, the majority of air from exiting out in that location, the slits 84 on the duct cover 76 are relatively narrow in width to allow only a portion of the air to exit. Specifically, the width of each slit 84 (front end to rear end) is narrower than the diameter of any of the openings 86. The remaining air then flows through the channel 78 and across the length of the duct cover 76, exiting out of the openings 86. Since frictional forces cause the air to slow down as it flows through the channel 78, the openings 86 in the duct cover 76 decrease in size from the upstream end to the downstream end of the channel 78 to ensure that substantially the same amount of air exits each opening 86.

In effect, the geometry of the channel causes more air to exit down from the slow moving air flowing near the downstream end of the channel 78 than the fast moving air flowing near the upstream end of the channel 78. Hence, the small openings 86 at the downstream end of the channel 78 restrict the air exiting out of channel 78 at that location. Also, the decreasing cross sectional area of the channel 78 forces the air to flow faster as it travels downstream so as to counteract somewhat the frictional forces and gravity that cause the air to slow down. Thus, the tapered channel 78, slits 84, and openings 86 are sized so that the working air exits evenly through the slits 84 and openings 86 of the channel 78. Therefore, the working air is distributed evenly along the cleaning path.

Also, this airflow system also reduces the noise level and improves nozzle recovery in the carpet extractor 20, since air exiting from the eye 66 of the motor fan 46 (FIG. 2) expands into the manifold 88 thereby slowing it down. The channel 78, slits 84 and openings 86 of the cover 76 also constrict the flow of air thereby increasing its temperature by transforming kinetic energy produced by the working fan into internal energy or heat, which is transferred to the exhaust air. Thus, additional heat is provided to the cleaning path.

Referring to FIG. 5, the duct cover 76 has three rear L-shaped locking tabs 96 and two pairs of hook members 98, 100 for mounting the duct cover 76 to the lower housing 40 over the outlet 74. Each locking tab 96 has a generally horizontal lower leg 102 at its free end. As illustrated in FIG. 7, the leg 102 rests upon the upper surface of the bottom plate 58 50 that the bottom plate 58 supports the duct cover 76. Each pair of hook members 98, 100 has opposing nose portions 104, 106, respectively, that hook onto corresponding retaining ribs 110, 112 integrally molded on rear wall 114 of the brush cavity 52 as seen in FIG. 4. Optionally, the duct cover 76 could also be integrally formed with the bottom plate 58.

Figure 8:
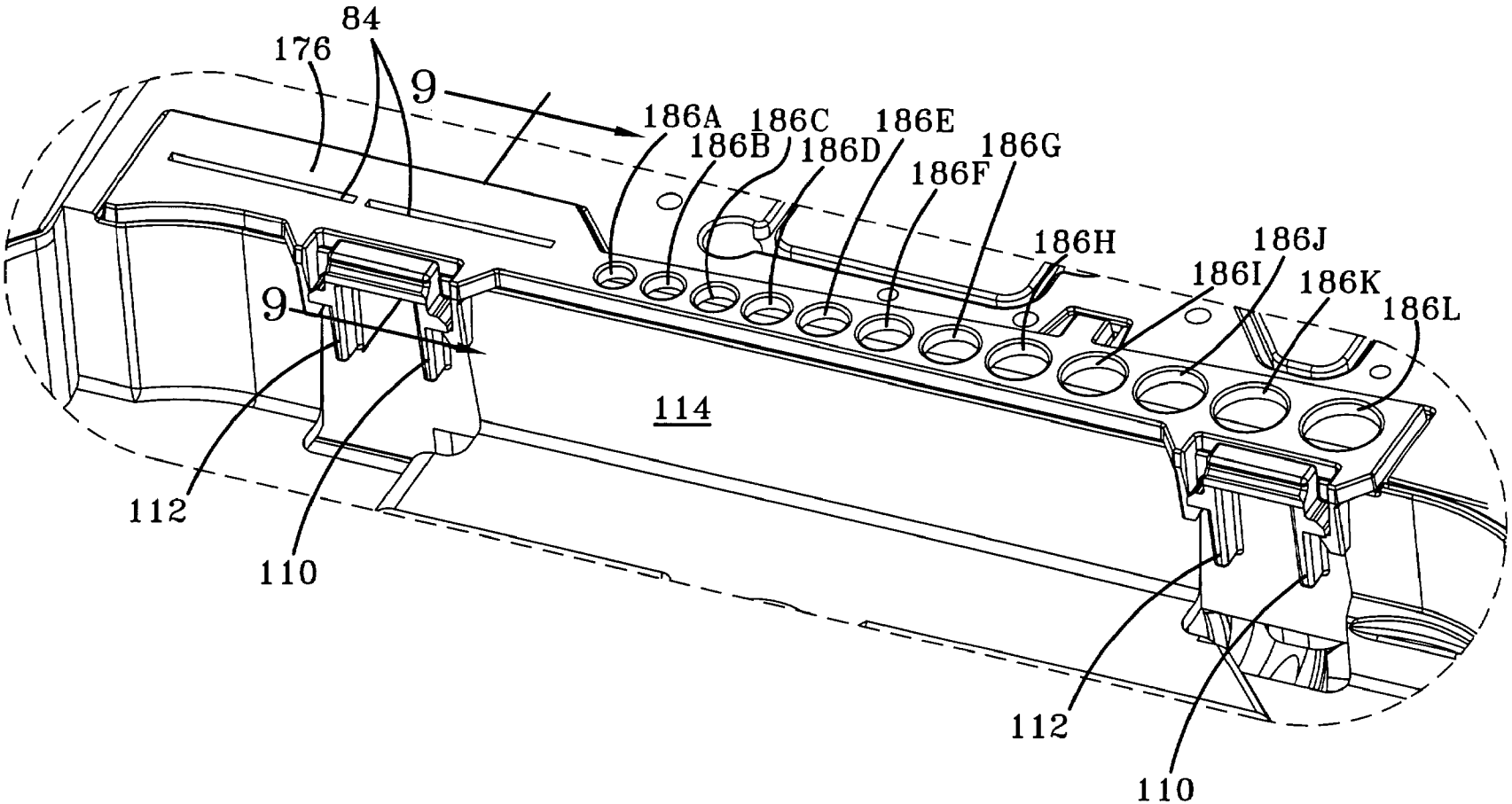
FIG. 8 is a view similar to FIG. 4 but showing a second embodiment of the present invention.
Figure 9:
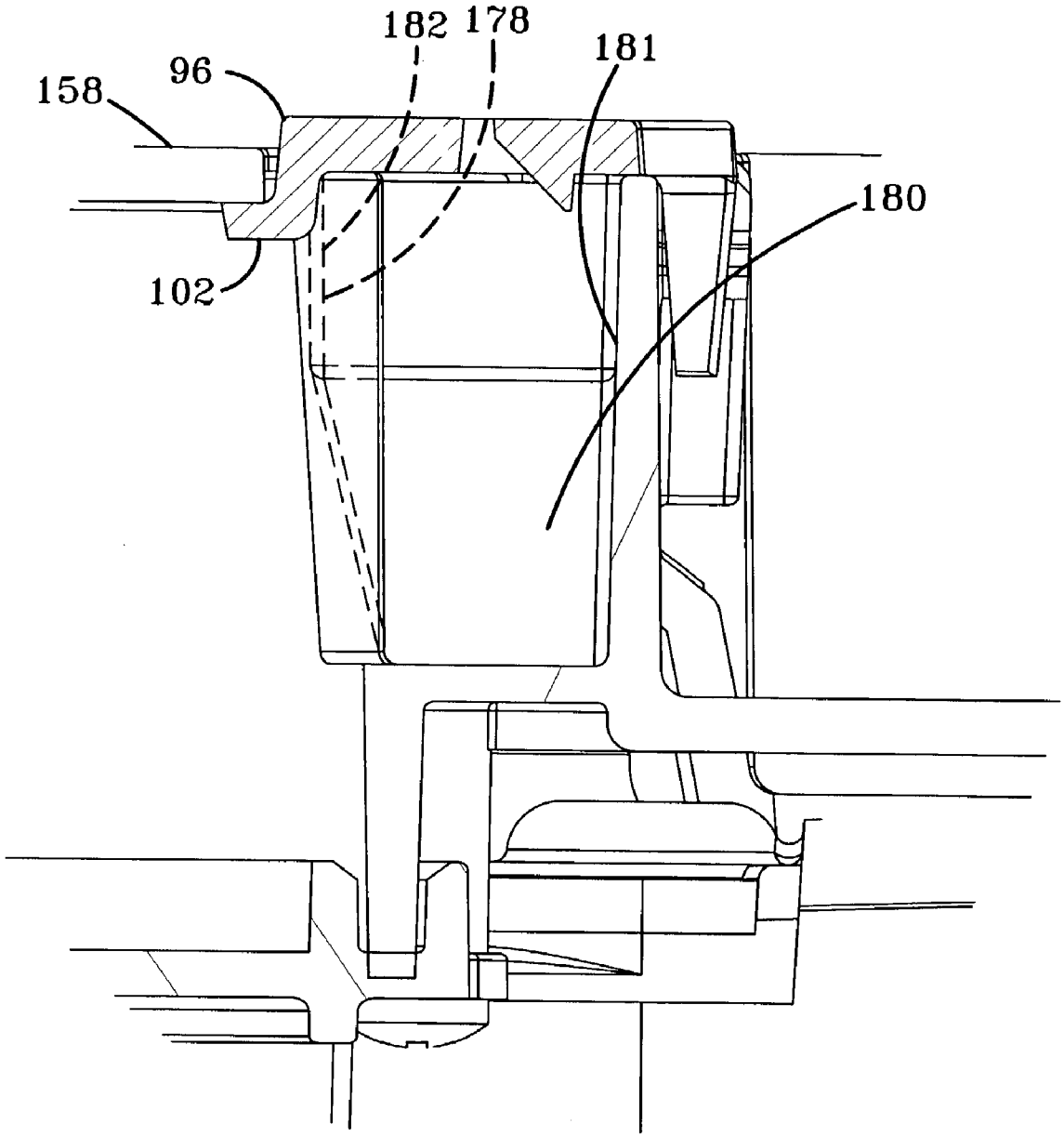
FIG. 9 is a sectional view taken along line 9-9 of FIG. 8.

Alternatively, FIGS. 8 and 9 disclose a second embodiment of the invention. In these figures, components from the previous embodiment shown in FIGS. 1 through 9, which are identical in structure and have identical functions will be identified by the same reference numbers. As seen in FIG. 9, the channel 178 still has its top side 180 tapering inwardly but has its rear side 182 tapering outwardly or rearwardly going from the upstream end to downstream end of the channel 178. As seen in FIG. 8, the duct cover 176 has the pair of collinear slits 84 and a row of circular vent openings 186A-L that are sized and arranged along the duct cover to allow the air to exit evenly across the tapered channel formed in the bottom plate 158. However, in this embodiment, the openings 186 in the duct cover 176 increase in size from the upstream end to the downstream end of the channel 178 to complement the geometry of the channel 178.

Figure 10:
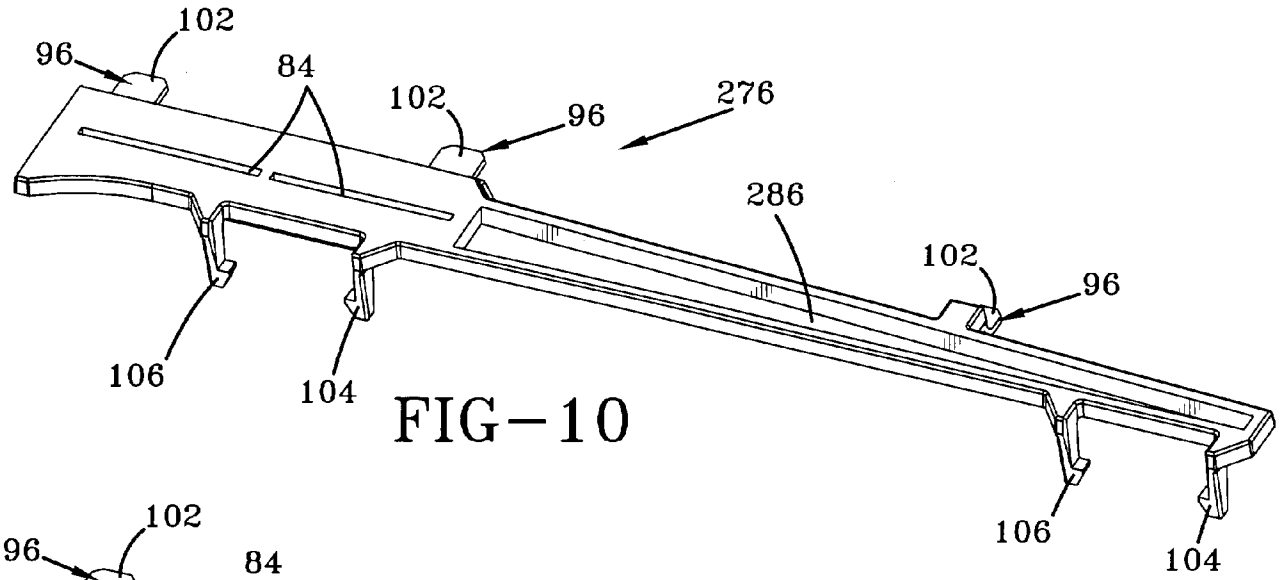
FIG. 10 is a top perspective view of the duct cover of a third embodiment of the invention.
Figure 11:
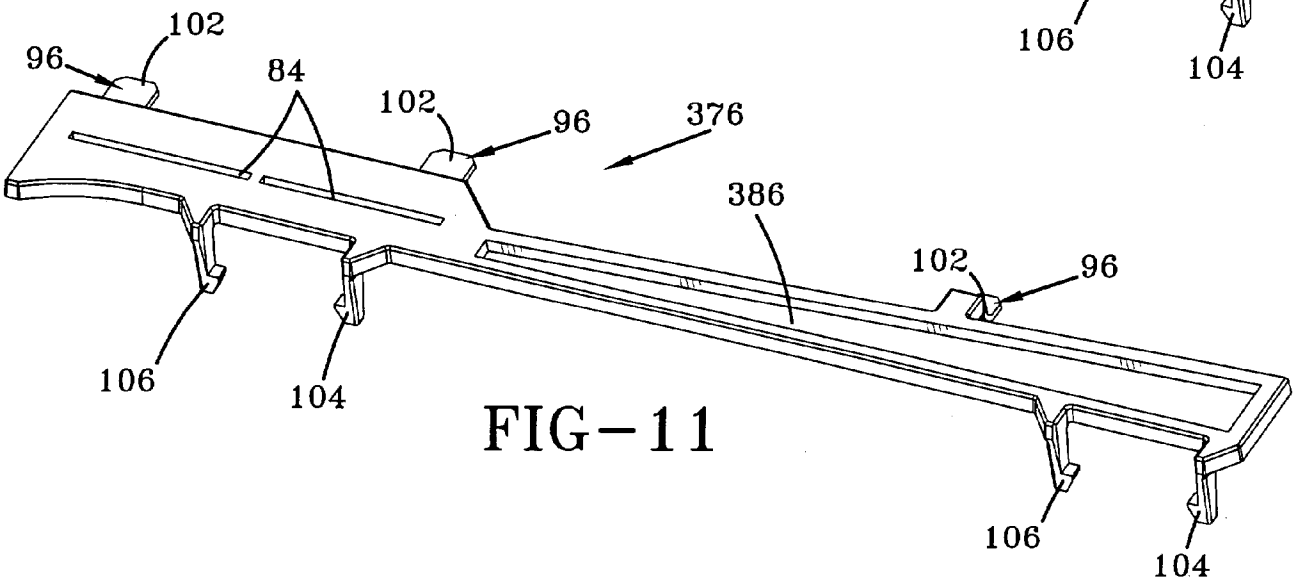
FIG. 11 is a top perspective view of the duct cover of a fourth embodiment of the invention.

In a third embodiment as shown in FIG. 10, the duct cover 276 could have one opening 286 instead of a row of several openings. This duct cover could cover the outlet 74 shown in FIGS. 1-7. In this embodiment, the opening 286 converges or decreases in size from the upstream to the downstream end of the channel 78. FIG. 11 shows a fourth embodiment in which the duct cover 376 has one opening 386 that diverges or increases in size from the upstream to the downstream end of the channel 178. This duct cover 376 could cover the outlet 174 of the embodiment shown in FIGS. 8 and 9.

As is commonly known, the carpet extractor 20 distributes cleaning solution to the carpeted cleaning surface and substantially simultaneously extracts it along with the dirt on the carpet in a continuous operation. In operation, a user grasps the hand grip 26 of the carpet extractor 20 and pushes the extractor 20 forwardly moving it across the surface. The user squeezes the trigger portion 32 with the index finger to distribute the cleaning solution. The brushes 38 scrub the solution into the carpet. The hot working air flows out of the duct cover substantially and evenly across the cleaning path as the carpet extractor moves along the cleaning path.

After completing this forward stroke, the user then pulls on the hand grip 26 moving the extractor 20 in the rearward direction to recover the cleaning solution and dirt on the cleaning path with the nozzle 44. The hot working air may aid in drying the carpet too. While moving the extractor 20 rearward, the user can also squeeze the trigger switch 32 to dispense additional cleaning solution onto the surface, which is also recovered along with the dirt using the nozzle 44. Alternatively, the user could simply dispense the cleaning solution on the carpet using the rearward stroke. During the rearward stroke, the hot working air flows evenly across the path before the cleaning solution is applied.

Optionally, a thumb button 33 is included just below the hand grip. When the thumb button 33 is depressed along with the trigger switch 32, an additional flow of cleaning solution is supplied to the distributor and distributed on the cleaning path. Further details of this feature is disclosed in Pat. No. 6,247,202; the disclosure which is incorporated herein by reference.

The present invention has been described by way of example using the illustrated embodiments. Upon reviewing the detailed description and the appended drawings, various modifications and variations of the embodiments will become apparent to one of ordinary skill in the art. All such obvious modifications and variations are intended to be included in the scope of the present invention and of the claims appended hereto.

For example, a horizontal brush roll could be used in lieu of the vertical axis gear brushes 38. Also, a heater can be provided in the extractor to further heat the working air or cleaning solution such as one disclosed in patent number 6,131,237; the disclosure of which is incorporated by reference. The air exhaust system can be implemented on an extractor having clean water and detergent tanks such as that disclosed in patent publication number US 2003/0226230 entided "Liquid Distribution System For A Cleaning Machine"; the disclosure of which is incorporated by reference. Further, the present invention can implemented on such an extractor, which incorporates a variable mixing valve to control the ratio of clean water and detergent from the tanks such as one disclosed by the above patent number 6,131,237.

In view of the above, it is intended that the present invention not be limited by the preceding disclosure of the embodiments, but rather be limited only by the appended claims.

What is claimed is:

1. A cleaning machine for cleaning a surface in which cleaning solution is dispensed to the surface and substantially extracted along with any dirt on the surface in a continuous operation comprising:

a) an airflow source;

b) an outlet associated with said airflow source for directing air generated by said airflow source out of said cleaning machine;

c) a duct cover covering said outlet; and d) wherein the air flows across and out of said outlet, said duct cover including one of (i) a row of openings decreasing in size from the upstream to the downstream direction of the air flowing across said outlet such that the air is distributed evenly across said outlet, (ii) a row of openings that increase in size from the upstream to the downstream direction of the air flowing across said outlet such that the air is distributed evenly across said outlet, (iii) at least one opening that decreases in size from the upstream to the downstream end such that the air is distributed evenly across said outlet and (iv) at least one opening that increases in size from the upstream to the downstream end such that the air is distributed evenly across said outlet.

2. The cleaning machine of claim 1 wherein said duct cover includes at least one slit formed at a location where the air initially flows along the length of said duct cover, said slit having a width narrower than the width of any said opening in said duct cover in accordance with the recitation in section (d)(i) through (d)(iv).

3. The cleaning machine of claim 1 wherein said duct cover includes said row of openings decreasing in size from the upstream to the downstream direction of the air flowing across said outlet, said outlet defining a channel wherein the cross sectional area of said channel decreases from the upstream to the downstream direction of the air flowing along said channel.

4. The cleaning machine of claim 1 including a base assembly for movement along a surface, said base assembly having a bottom portion, said outlet extending substantially along the width of said bottom portion.

5. The cleaning machine of claim 4 including a handle pivotally connected to said base assembly, a liquid distribution system associated with said base assembly, said liquid distribution system including a source containing a supply of said cleaning solution and a distributor fluidly connected to said source for distributing said cleaning solution to the surface, a liquid recovery system associated with said base assembly and including a suction nozzle, wherein said airflow source is in fluid communication with said suction nozzle for generating suction to draw the cleaning solution and dirt laden air from the surface and through the suction nozzle.

6. The cleaning machine of claim 5 wherein said liquid recovery system includes a recovery tank in fluid communication with said suction nozzle and said airflow source, for retaining dirt and cleaning solution extracted by the cleaning machine, said recovery tank separating the air from the dirt and cleaning solution and allowing the separated air to flow to said outlet extending substantially along with width of said bottom portion of said base assembly.

7. A cleaning machine for cleaning a surface in which cleaning solution is dispensed to the surface and substantially extracted along with any dirt on the surface in a continuous operation comprising:

a) an airflow source;

b) a base assembly for movement along a surface, said base assembly having a bottom portion, an outlet extending substantially along the width of said bottom portion, said outlet associated with said airflow source for directing air generated by said airflow source out of said cleaning machine;

c) a duct cover covering said outlet, said duct cover being substantially parallel with said bottom portion; and d) wherein the air flows across and out of said outlet, said duct cover including at least one opening that is sized and oriented to distribute the air evenly across said outlet.

8. The cleaning machine of claim 7 wherein said duct cover is integrally formed with said bottom portion.

9. The cleaning machine of claim 7 wherein said opening decreases in size from the upstream to the downstream direction of air flowing across said outlet such that the air is distributed evenly across said outlet.

10. The cleaning machine of claim 9 wherein said duct cover includes at least one slit formed at a location where the air initially flows along the length of said duct cover, said slit having a width with respect to said duct cover that is narrower than the width of said opening.

11. The cleaning machine of claim 9 wherein said outlet defines a channel, wherein the cross sectional area of said channel decreases from the upstream to the downstream direction of the air flowing along said channel.

12. The cleaning machine of claim 7 wherein said at least one opening in said duct cover is provided by a plurality of openings that are arranged in a row and decrease in size from the upstream to the downstream direction of the air flowing across said outlet such that the air is distributed evenly across said outlet.

13. The cleaning machine of claim 12 wherein said duct cover includes at least one slit formed at a location where the air initially flows along the length of said duct cover, said slit having a width with respect to said duct cover that is narrower than the width of said plurality of openings.

14. The cleaning machine of claim 12 wherein said outlet defines a channel, wherein the cross sectional area of said channel decreases from the upstream to the downstream direction of the air flowing along said channel.

15. The cleaning machine of claim 7 wherein said opening decreases in size from the upstream to the downstream direction of the air flowing across said outlet such that the air is distributed evenly across said outlet.

16. The cleaning machine of claim 7 wherein said at least one opening in said duct cover is provided by a plurality of openings that are arranged in a row and increase in size from the upstream to the downstream direction of air flowing across said outlet such that the air is distributed evenly across said outlet.

17. The cleaning machine of claim 7 including a handle pivotally connected to said base assembly, a liquid distribution system associated with said base assembly, said liquid distribution system including a source containing a supply of said cleaning solution and a distributor fluidly connected to said source for distributing said cleaning solution to the surface, a liquid recovery system associated with said base assembly and including a suction nozzle, wherein said airflow source is in fluid communication with said suction nozzle for generating suction to draw the cleaning solution and dirt laden air from the surface and through the suction nozzle.

18. The cleaning machine of claim 17 wherein said recovery system includes a recovery tank in fluid communication with said suction nozzle and said airflow source, said recovery tank containing the dirt and cleaning solution flowing into said recovery tank, said recovery tank separating the air from the dirt and cleaning solution and allowing the separated air to flow out of said recovery tank to said outlet of the base assembly.

19. A cleaning machine for cleaning a surface in which cleaning solution is dispensed to the surface and substantially extracted along with any dirt on the surface in a continuous operation comprising:

a) a housing;

b) an airflow source operatively connected to said housing;

c) an outlet associated with said airflow source for directing air generated by said airflow source out of said cleaning machine;

d) a distributor operatively connected at least in part to said housing, said distributor having an outlet in which the cleaning solution flows out to the surface;

e) a duct cover covering said outlet of said airflow source, said duct cover being located rearwardly from said outlet of said distributor; and f) wherein the air flows across and out of said outlet of said airflow source, said duct covering including at least one opening that is sized and oriented to distribute the air evenly across said outlet of said airflow source.

20. The cleaning machine of claim 19 including a brush assembly operatively connected to said housing, said duct cover being located rearwardly adjacent said brush assembly.

21. The cleaning machine of claim 19 wherein said brush assembly is rotatable.

22. The cleaning machine of claim 21 wherein said opening decreases in size from the upstream to the downstream direction of the air flowing across said outlet such that the air is distributed evenly across said outlet.

23. The cleaning machine of claim 22 wherein said duct cover includes at least one slit formed at a location where the air initially flows along the length of said duct cover, said slit having a width with respect to said duct cover that is narrower than the width of said opening.

24. The cleaning machine of claim 22 wherein said outlet defines a channel, wherein the cross sectional area of said channel decreases from the upstream to the downstream direction of the air flowing along said channel.

25. The cleaning machine of claim 19 wherein said opening decreases in size from the upstream to the downstream direction of the air flowing across said outlet such that the air is distributed evenly across said outlet.

26. The cleaning machine of claim 25 wherein said duct cover includes at least one slit formed at a location where the air initially flows along the length of said duct cover, said slit having a width with respect to said duct cover that is narrower than the width of said opening.

27. The cleaning machine of claim 25 wherein said outlet defines a channel, wherein the cross sectional area of said channel decreases from the upstream to the downstream direction of the air flowing along said channel.

28. The cleaning machine of claim 19 wherein said at least one opening in said duct cover is provided by a plurality of openings that are arranged in a row and decrease in size from the upstream to the downstream direction of the air flowing across said outlet such that the air is distributed evenly across said outlet.

29. The cleaning machine of claim 28 wherein said duct cover includes at least one slit formed at a location where the air initially flows along the length of said duct cover, said slit having a width with respect to said duct cover that is narrower than the width of said opening.

30. The cleaning machine of claim 28 wherein said outlet defines a channel, wherein the cross sectional area of said channel decreases from the upstream to the downstream direction of the air flowing along said channel.

31. The cleaning machine of claim 19 wherein said at least one opening in said duct cover is provided by a plurality of openings that are arranged in a row and increase in size from the upstream to the downstream direction of the air flowing across said outlet such that the air is distributed evenly across said outlet.

* * * * *